US005403004A

United States Patent [19]

Kennedy

[11] Patent Number: 5,403,004

[45] Date of Patent: Apr. 4, 1995

[54] SLOT CAR RACING SET WITH INTERMITTENT OBSTRUCTION

[75] Inventor: Melvin R. Kennedy, Lantana, Fla.

[73] Assignee: Life-Like Products, Inc., Baltimore, Md.

[21] Appl. No.: 199,062

[22] Filed: Feb. 22, 1994

[51] Int. Cl.[6] ..... A63F 9/14

[52] U.S. Cl. ..... 273/86 R; 273/86 B; 446/444

[58] Field of Search ..... 273/86 R, 86 B, 86 C, 273/86 D, 86 E, 86 F; 446/444, 445, 446, 447; 104/60, 61, 63, 64, 65, 67

[56] References Cited

U.S. PATENT DOCUMENTS 2,161,314 6/1939 Randall et al. ..... 104/60
3,430,581 3/1969 Truesdell et al. ..... 104/60
4,383,688 5/1983 Prehodka ..... 273/86 B

FOREIGN PATENT DOCUMENTS 3016249 11/1981 Germany ..... 273/86 B

*Primary Examiner*—Vincent Millin
*Assistant Examiner*—William M. Pierce
*Attorney, Agent, or Firm*—Mark P. Stone

[57] ABSTRACT

An electric slot car racing track includes a "spin out track" for providing an intermittent and temporary obstruction to one or more of the slot car racing lanes. The obstruction is provided in the form of a simulated vehicle which temporarily blocks the path of one or more of the racing lanes to test the skills of the participating drivers in avoiding the obstruction. The "spin out track" provides an added degree of unpredictability or chance to the ultimate outcome of the race, therefore making the toy racing set the more attractive to younger or less skilled children. The frequency and duration of the intermittent obstruction is regulated by electrical controls which are actuated by movement of the racing vehicles over a sensing element. The electrical control is provided as a unit integrated into the spin out track section such that this track section may be installed and employed in conventional slot racing sets.

14 Claims, 3 Drawing Sheets

SLOT CAR RACING SET WITH INTERMITTENT OBSTRUCTION

BACKGROUND OF THE INVENTION

Electric slot car racing sets are well known to the prior art. These sets include electrical means for energizing one or more racing paths which complete an electrical circuit and are coupled to an electrical source of energy. Electrical conductor means on the racing vehicles are inserted into slots defined in the racing paths to provide electrical energy from the electrical source to an electric motor within the slot car through the electrical conductor received in the slot. Means are provided by which the participants in a race can adjust the value of electrical energy supplied to the racing slots defining the paths for controlling the energization and thus the speed of the electrical slot car travelling in the electrical racing slot path. The outcome of a race is determined primarily by the skill of the participant—namely, the ability to maintain a sufficiently high speed but yet still permit the slot car to negotiate twists and turns without disengaging the car from the track.

It is apparent that physical skill and manual dexterity of the participants in a slot race are the primary factors in determining the winner of such contests. Accordingly, persons lacking such physical skills or dexterity are discouraged from participating in slot races or otherwise employing slot car racing toys for entertainment purposes. It is a primary object of the present invention to encourage younger children or persons having limited manual dexterity or ability to participate in slot car racing contests. This object is accomplished by adding a degree of randomness or chance to the outcome of a slot car race. In this manner, the winner of a race will not be determined exclusively by skill, but will depend upon a combination of skill and chance.

Other objects and advantages of the present invention will become apparent from the following description and discussion.

SUMMARY OF THE INVENTION

In accordance with the present invention, an electric slot car racing set includes a "spin out track" section for providing a random, intermittent and temporary obstruction to the paths of the racing toy slot cars. The track section includes electrical means for actuating mechanical means to move an obstruction, preferably configured in the form of a vehicle, along a groove oriented transversely to the slots defining the racing paths, to temporarily obstruct one or more of the racing slot paths. The electrical and mechanical control means for the obstruction device, together with the obstruction device, are formed as a single unit together with the track section. Accordingly, this track section can be employed in conventional slot car racing sets to provide the random obstruction in accordance with the present invention. The obstruction control means, which are actuated and controlled by movement of the electric slot racers over the obstruction track section, determines the frequency and duration of the obstruction to the racing paths.

The slot car racing track, together with the obstruction track section, adds a degree of unpredictability, randomness or chance to the outcome of a slot car race. Since the results of the race are not exclusively based upon the skill of the participating drivers, younger children or less skilled individuals will be encouraged to participate in the races. Additionally, the random obstruction provides further excitement for skilled participants by enabling them to use their expertise to properly respond and react to the random, intermittent obstructions provided by the obstruction track section in accordance with the present invention.

DESCRIPTION OF THE BEST MODES FOR CARRYING OUT THE INVENTION

Figure 1:
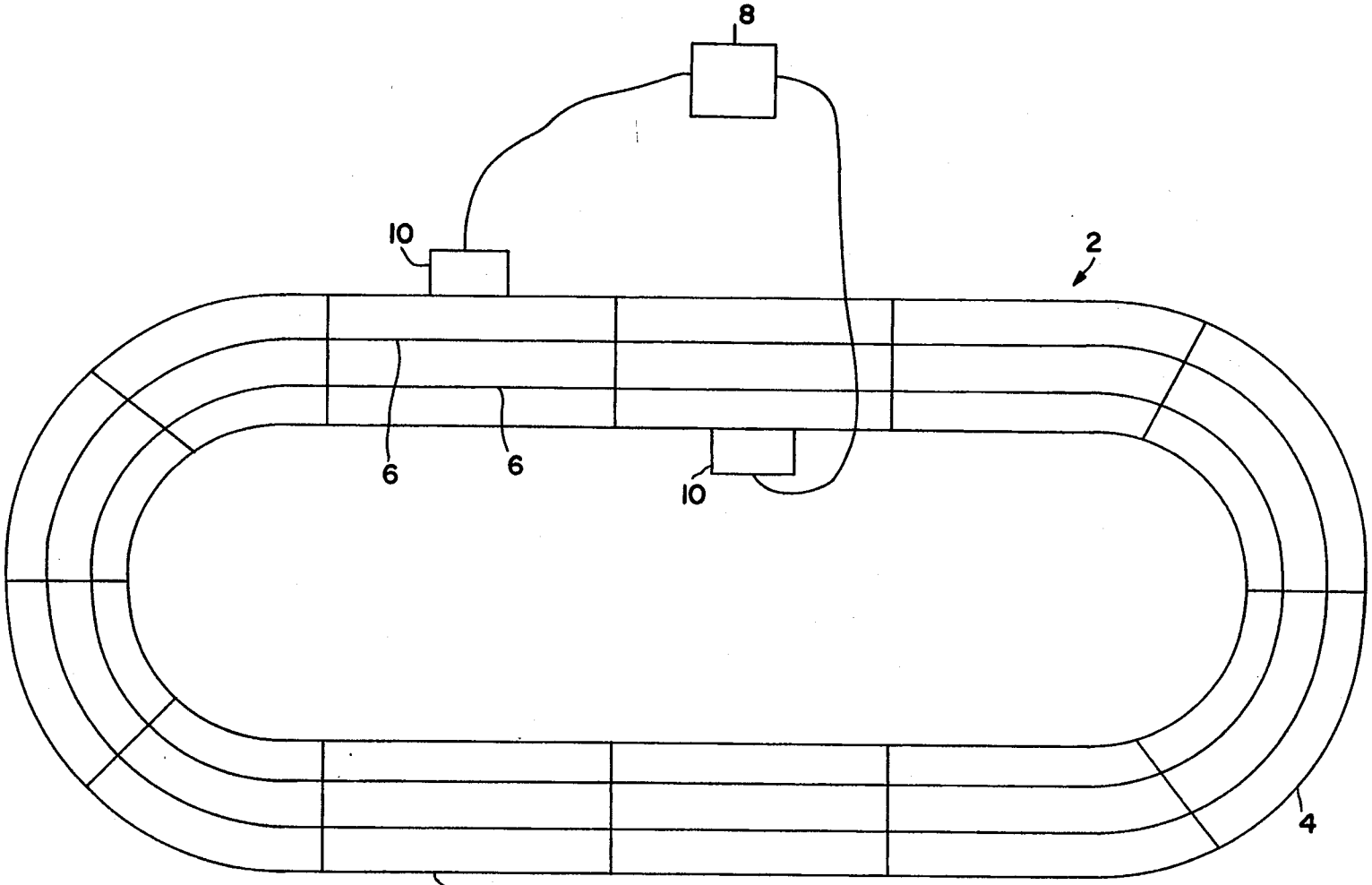
FIG. 1 of the drawing illustrates a top plan view of slot car racing set assembled from a plurality of track sections, and electrical energization means.

The slot car racing set, including the intermittent obstruction means in accordance with the present invention, will now be discussed in greater detail with reference to FIGS. 1–3 of the drawing.

FIG. 1 generally illustrates the features of a conventional slot car racing set. An oval shaped race track, generally illustrated by reference numeral 2, is formed from a plurality of separate track sections 4 which are removably coupled together. Each section includes two slots 6 defining a closed oval loop when the track sections are assembled. The slots 6 are each provided with separate electrical conductor means which are electrically coupled to other conductor means in different track sections 4 when the race track 2 is assembled. A power supply 8, generally a transformer coupled to a source of line voltage, is electrically connected to the assembled race track. Electrical control means 10 are provided for independently adjusting the electrical current supplied to the separate electrical conductors of each of the two slots 6 of the race track. In this manner, the electrical current, and thus the speed of a slot car received in one of the slots 6, is separately controlled by the participants in a slot car race. As is well known to the slot car racing art, the slot cars each include an electrical contact for conducting electrical current from the conductors in the slot, through the contact on the slot car, and to an electric motor for powering the car along the closed race track.

Figure 2:
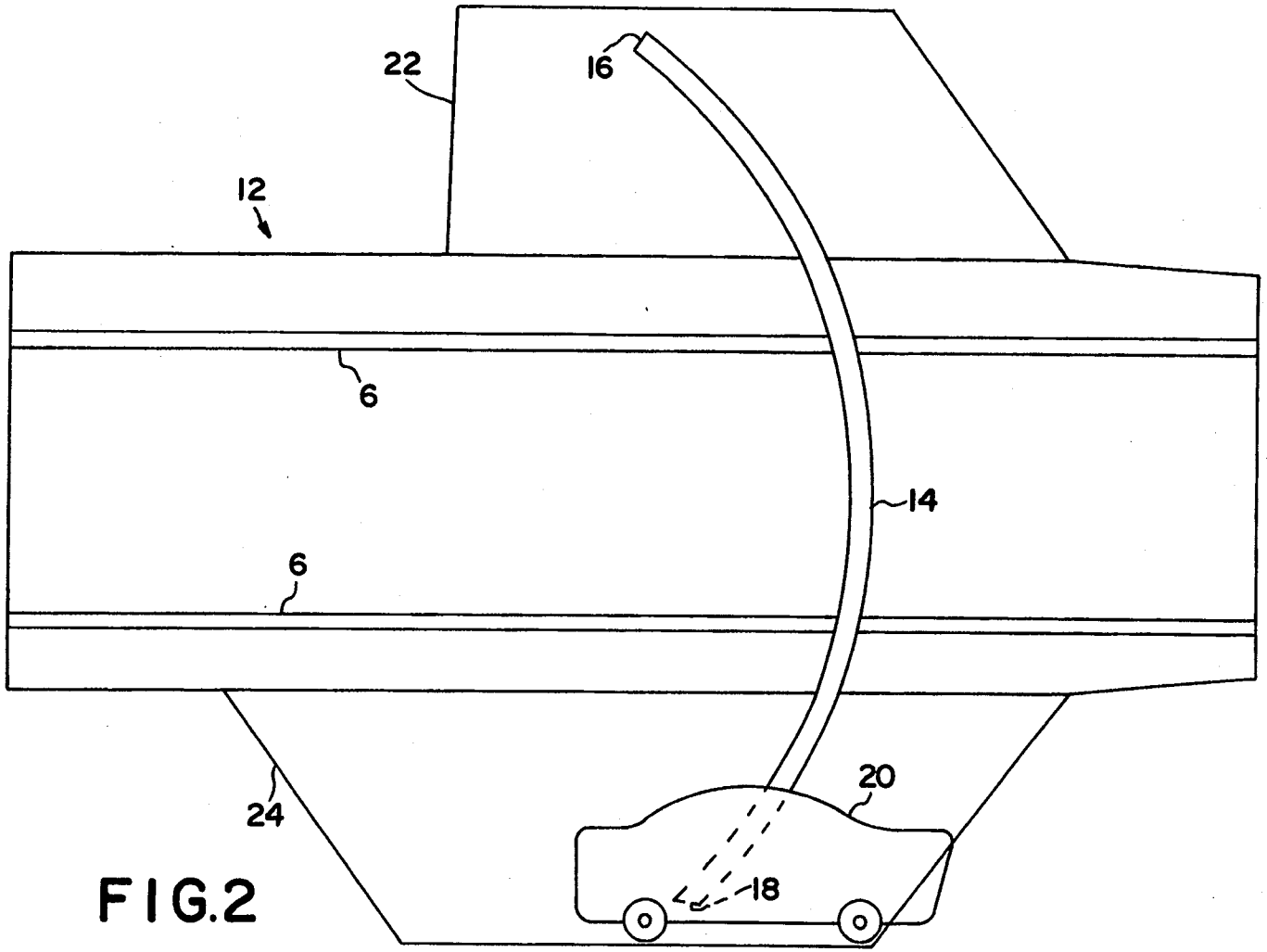
FIG. 2 illustrates a top plan view of an obstruction track section for a slot car racing set in accordance with the present invention.

FIG. 2 of the drawing illustrates a track section, in accordance with the present invention, for providing an intermittent and temporary obstruction to the slots 6. The obstruction track section is generally designated by the reference numeral 12, and is removably connected to other track sections 4 for completing the oval racetrack 2. Track section 12 includes an arcuate groove 14 which extends across the two racing slots 6 in a substantially transverse or perpendicular orientation relative to the two parallel slots 6. A pivotable lever (not shown in FIG. 2) is positioned beneath the groove 14 and is movable between end portions 16 and 18 of the arcuate groove. The lever includes means for retaining an obstruction device, as for example, a model car 20 such that reciprocal movement of the lever between groove ends 16 and 18 causes the model car 20 to move back and forth across the two racing slots 6 in the track section 12. As will be described in greater detail below, when the pivotable lever beneath the arcuate groove 14 is actuated, the obstructing car 20 is reciprocally moved across the racing slots 6 to provide an intermittent and temporary obstruction to each of the racing slots. When the obstruction device is not actuated, it remains on one of the two side shoulders 22 and 24 of the track section 12, and does not block either of the racing slots 6. The participants of a slot car race, not knowing when the obstructing device will be actuated and the obstruction car 20 will be moved reciprocally across the racing slots, are required to take spontaneous corrective action to avoid a collision between their respective slot racing cars and the obstructing car 20. Accordingly, the intermittent and reciprocating obstruction over the racing slots 6 adds an element of chance to the final outcome of a slot car race, and the results of the race are not based exclusively on the skills of the respective participants.

Figure 3:
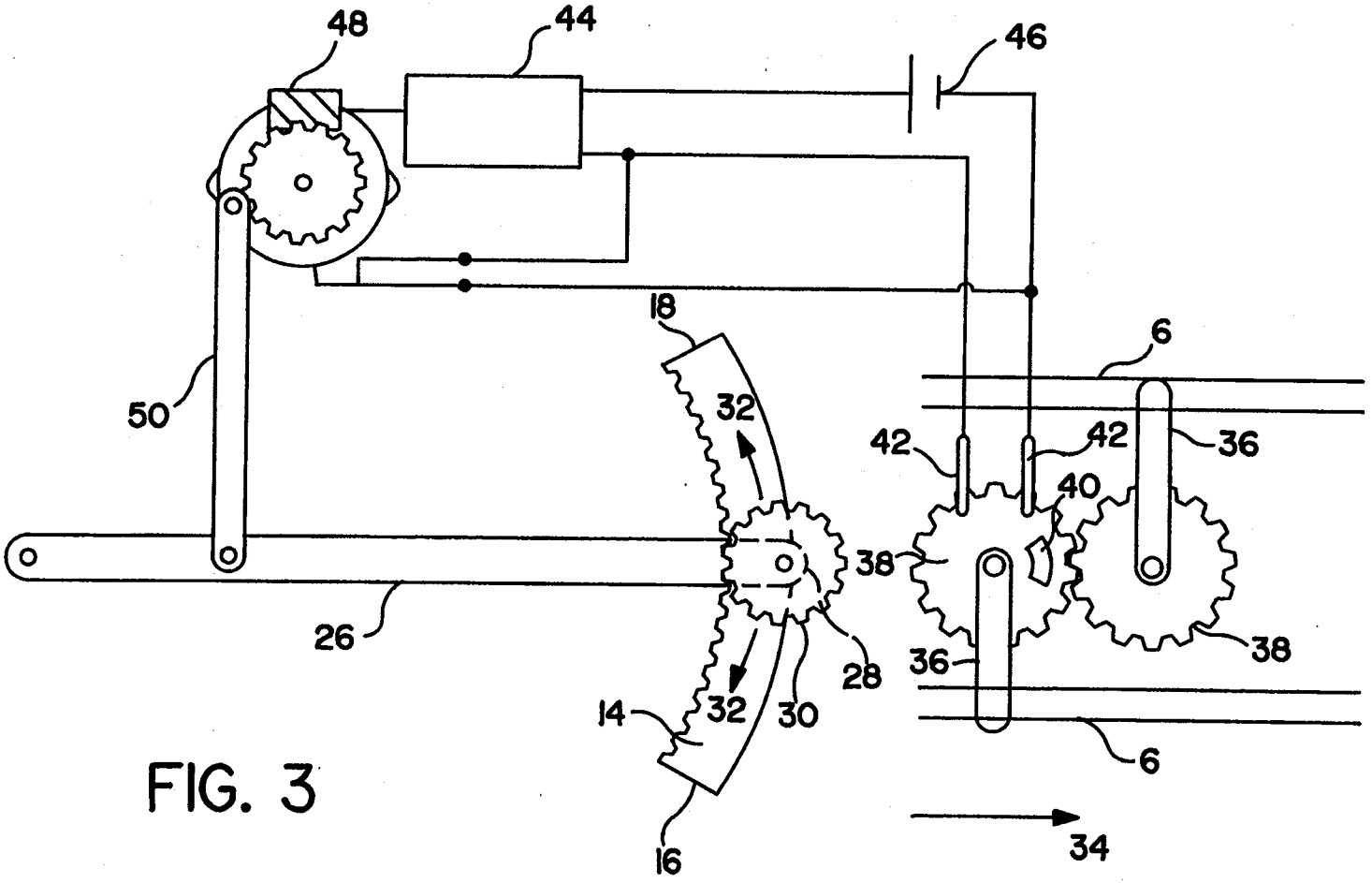
FIG. 3 illustrates the electrical and mechanical means for controlling the obstruction track section for a slot car racing set in accordance with the present invention.

Referring now to FIG. 3 of the drawing, the preferred embodiment of an electrical circuit for actuating the mechanical obstruction means of the present invention is schematically illustrated. FIG. 3 is a bottom plan view of the track section 12 underneath the arcuate groove 14. As illustrated by this drawing figure, an oscillating arm or lever 26 includes a free end 28 which extends towards and terminates in the arcuate groove 14. End portion 28 includes means 30 for mounting the obstruction car 20 on the upper surface of the arcuate groove 14. The mounting means 30 further includes means for spinning the car 20 about the end 28 of the lever 26 as the lever reciprocates in the groove 14 in the direction of movement indicated by the directional arrows 32. As the lever 26 reciprocates in the groove 14, the car 20 intermittently obstructs the two racing slots 6 defined in the track section 12.

Still referring to FIG. 3, as the slot cars in the two slots 6 advance in the race direction indicated by directional arrow 34, each slot car engages an actuator 36 positioned in the respective slot 6, causing a pair of coupled gears 38 to rotate sequentially in a predetermined direction. One of the gears carries a conductive electrical contact 40 which rotates together with gear. The contact 40 is intermittently rotated into a position in which it electrically connects two switch contacts 42, mounted in a stationary position relative to the rotating gear, to complete an electrical circuit between a motor 44 and a battery 46. The motor is then energized to drive a worm and wormgear combination 48 to impart eccentric movement to a shaft 50 coupled to the worm and wormgear combination. The shaft 50 is mechanically coupled to the lever or oscillating arm 26 to cause the free end 28 of the lever to reciprocate in the arcuate groove 14 between the opposed end portions 16 and 18 of the groove. As the lever reciprocates, the car 20 is caused to move back and forth across the racing slots 6 to provide an intermittent and temporary obstruction to the slot car racers.

As the slot cars continue to advance over the actuators 36, the pair of gears 38 are further sequentially rotated such that the electrical conductive contact 40 is moved out of engagement from the switch contacts 42. When this occurs, the electrical circuit between the battery 46 and the motor 44 is broken, and the motor no longer drives the worm and worm gear. A cycle switch (not shown in the drawing) ensures that the obstruction vehicle 20 will remain at one of the two end positions 16 and 18 in the arcuate groove 14 in one of the side shoulders 22 and 24 of the track section 12, and thus not obstructing either of the racing slots 6, when the motor 44 is deactuated.

It is thus apparent from the above description that the obstruction means (i.e., obstructing vehicle 20) is reciprocally moved across the racing slots 6 to provide a temporary obstruction to the slot car racers moving along the slots 6 at intermittent frequencies and for intermittent durations, depending upon the actuation of the rotating gears 38 by the racing slot cars. The obstructing means thus provide a spontaneous, moving obstruction to the racetrack, requiring the respective drivers to take corrective action, and thus adding an element of chance or spontaneity to the outcome of the race.

As one possible alternative to the embodiment of the electrical circuitry disclosed in FIG. 3, timer means may be provided to control the frequency and duration of the reciprocating obstruction to the racing slots. The timer means may include program means for setting or adjusting the frequency and/or duration of the reciprocating obstruction across the two racing slots 6.

The slot car racing track, including the obstruction means in accordance with the present invention, provides excitement and entertainment by adding an element of chance or unpredictability to the contest. By adding this element of chance to the outcome of the contest, younger or less skilled individuals are encouraged to compete with older or more skilled individuals since the result of the race is not dependent exclusively upon skill or manual dexterity. Furthermore, even skilled slot car racing enthusiasts are able to enhance their expertise by requiring corrective action to be taken in response to spontaneous conditions encountered during the course of a slot car race.

Other modifications and advantages within the scope of the present invention will become apparent to those skilled in the art. Accordingly, the above description of the best mode is intended to be illustrative only, and not restrictive of the scope of the invention, that scope being defined by the following claims and all equivalents thereto.

I claim:

1. In an electric slot car racing set including a plurality of track sections and means for removably connecting said track sections into a closed configuration, each of said track sections including at least one racing slot for receiving a slot car racing vehicle and electrical conductor means in each of said track sections for engaging an electrical conductor portion of said slot car racing vehicle inserted into said slot, said electrical conductors in said track sections defining a closed electrical circuit when said track sections are assembled into said closed configuration, and means for selectively supplying electrical energy to said electrical circuit, the improvement comprising:

means for temporarily obstructing said at least one slot for receiving said slot car racing vehicle, said means for temporarily obstructing said racing slot including a groove defined in a portion of one of said plurality of track sections, said groove intersecting said racing slot, and means for selectively moving a blocking device in said groove.

2. The improvement as claimed in claim 1 further including means for actuating said means for temporarily obstructing said racing slot.

3. The improvement as claimed in claim 2 further including means for deactuating said means for temporarily obstructing said racing slot.

4. The improvement as claimed in claim 3 wherein said means for deactuating said means for temporarily obstructing said racing slot is responsive to the movement of said slot car racing vehicle over a predetermined position on said assembled track.

5. The improvement as claimed in claim 2 wherein said means for actuating said means for temporarily obstructing said racing slot is responsive to the movement of said slot car racing vehicle over a predetermined position on said assembled track.

6. The improvement as claimed in claim 2 wherein said means for actuating said means for temporarily obstructing said racing slot includes timer means.

7. The improvement as claimed in claim 1 wherein said groove is arcuate in shape.

8. The device as claimed in claim 1 wherein said groove is oriented substantially transverse to said at least one racing slot.

9. The device as claimed in claim 1 wherein said blocking device is configured in the shape of a toy vehicle.

10. The improvement as claimed in claim 9 wherein said blocking device includes means for pivoting said blocking device as said blocking device is moved in said groove.

11. The improvement as claimed in claim 1 wherein said means for temporarily obstructing further includes means for reciprocally moving said blocking device in said groove between two opposed ends of said groove.

12. In an electric slot racing set including a plurality of track sections and means for removably connecting said track sections into a closed configuration, each of said track sections including at least one racing slot for receiving a slot car racing vehicle and electrical conductor means in each of said track sections for engaging an electrical conductor portion of said slot car racing vehicle inserted into said slot, said electrical conductors in said track sections defining a closed electrical circuit when said track sections are assembled into said closed configuration, and means for selectively supplying electrical energy to said electrical circuit, the improvement comprising:

means for temporarily obstructing said at least one slot for receiving said slot car racing vehicle, said means for temporarily obstructing including at least one gear rotatably mounted beneath at least one track section, means for sequentially rotating said gear in a predetermined direction in response to movement of a slot car racing vehicle over said one track section, said gear carrying an electrical conductor fixedly mounted relative to said gear and movable therewith, and a pair of electrical switch contacts at a predetermined position relative to said gear such that said electrical contact carried on said gear intermittently connects and disconnects said pair of switch contacts as said gear sequentially rotates.

13. The improvement as claimed in claim 12 wherein further including circuit means for actuating said means for temporarily obstructing said racing slot when said electrical contact on said gear electrically connects said pair of switch contacts.

14. The improvement as claimed in claim 12 further including a gear actuator for sequentially rotating said gear in said predetermined direction, said gear actuator being positioned proximate to said racing slot such that said actuator is engaged by a slot racing vehicle travelling in said racing slot car.

* * * * *